US008267718B2

(12) United States Patent
Straka et al.

(10) Patent No.: US 8,267,718 B2
(45) Date of Patent: Sep. 18, 2012

(54) HIGH DATA RATE ELECTRICAL CONNECTOR AND CABLE ASSEMBLY

(75) Inventors: Frank M. Straka, Chicago, IL (US); Nicholas G. Martino, Crete, IL (US); Satish I. Patel, Roselle, IL (US); Gina L. Sepic, Hammond, IN (US)

(73) Assignee: Panduit Corp., Tinley Park, IL (US)

( * ) Notice: Subject to any disclaimer, the term of this patent is extended or adjusted under 35 U.S.C. 154(b) by 90 days.

(21) Appl. No.: 12/755,669

(22) Filed: Apr. 7, 2010

(65) Prior Publication Data

US 2011/0250791 A1 Oct. 13, 2011

(51) Int. Cl.
*H01R 12/24* (2006.01)

(52) U.S. Cl. ..... 439/497; 439/76.1

(58) Field of Classification Search ..... 439/76.1, 439/493, 497, 579, 607.09
See application file for complete search history.

(56) References Cited

U.S. PATENT DOCUMENTS

| | | | |
|---|---|---|---|
| 6,380,485 | B1 | 4/2002 | Beaman et al. |
| 6,431,887 | B1 | 8/2002 | Yeomans et al. |
| 6,434,015 | B1 | 8/2002 | Hwang |
| 6,517,382 | B2 | 2/2003 | Flickinger et al. |
| 6,530,785 | B1 | 3/2003 | Hwang |
| 6,533,603 | B1 | 3/2003 | Togami |
| 6,565,366 | B1 | 5/2003 | Wu |
| 6,612,859 | B2 | 9/2003 | Yeomans et al. |
| 6,641,429 | B1 | 11/2003 | Wu |
| 6,655,995 | B1 | 12/2003 | Reisinger et al. |
| 6,659,790 | B1 | 12/2003 | Wu |
| 6,666,720 | B1 | 12/2003 | Reisinger et al. |
| 6,685,501 | B1 | 2/2004 | Wu et al. |
| 6,716,057 | B1 * | 4/2004 | Wu ..... 439/497 |
| 6,733,322 | B2 | 5/2004 | Boemmel et al. |
| 6,773,305 | B2 | 8/2004 | Wu |
| 6,786,653 | B1 | 9/2004 | Hwang et al. |
| 6,786,763 | B2 | 9/2004 | Wu |
| 6,872,094 | B1 | 3/2005 | Murr et al. |
| 6,881,095 | B2 | 4/2005 | Murr et al. |
| 6,887,091 | B1 | 5/2005 | Wu |
| 6,916,196 | B2 | 7/2005 | Long et al. |
| 6,916,198 | B2 | 7/2005 | Wu et al. |
| 7,081,002 | B2 | 7/2006 | De Vanssay et al. |
| 7,175,444 | B2 | 2/2007 | Lang et al. |

(Continued)

FOREIGN PATENT DOCUMENTS

JP 6208864 A 7/1994

*Primary Examiner* — Thanh Tam Le
(74) *Attorney, Agent, or Firm* — Robert A. McCann; Christopher S. Clancy; Christopher K. Marlow

(57) ABSTRACT

An electrical connector has a first shell, an opposing second shell and a circuit board between the first shell and the second shell. The circuit board has a first side and an opposing second side and includes a plurality of differential pair conductive traces on each side. A first drain wire termination device is provided on the first side and includes at least one separator between at least one of the differential pair conductive traces on the first side and another of the differential pair conductive traces on the first side. A second drain wire termination device is connected to the second side and includes at least one separator between at least one of the differential pair conductive traces on the second side and another of the differential pair conductive traces on the second side.

15 Claims, 20 Drawing Sheets

U.S. PATENT DOCUMENTS

| | | | | |
|---|---|---|---|---|
| 7,175,446 | B2 | 2/2007 | Bright et al. | |
| 7,175,475 | B2 | 2/2007 | Hanley | |
| 7,198,519 | B2 | 4/2007 | Regnier et al. | |
| 7,281,937 | B2 | 10/2007 | Reed et al. | |
| 7,281,938 | B1 | 10/2007 | Wu | |
| 7,303,438 | B2 | 12/2007 | Dawiedczyk et al. | |
| 7,318,740 | B1 | 1/2008 | Henry et al. | |
| 7,435,132 | B1 * | 10/2008 | Fong et al. | 439/497 |
| 7,497,724 | B1 | 3/2009 | Fong et al. | |
| 8,011,950 | B2 * | 9/2011 | McGrath et al. | 439/497 |
| 2006/0014438 | A1 | 1/2006 | Regnier | |
| 2006/0134993 | A1 | 6/2006 | Dawiedczyk et al. | |
| 2006/0160429 | A1 | 7/2006 | Dawiedczyk et al. | |
| 2010/0029104 | A1 | 2/2010 | Patel et al. | |

* cited by examiner

HIGH DATA RATE ELECTRICAL CONNECTOR AND CABLE ASSEMBLY

BACKGROUND OF THE INVENTION

1. Field of the Invention

The present invention relates to a high data rate electrical connector and cable assembly and, more particularly, to a connector/cable assembly which includes a connector or connectors attached to a cable having multiple twin-ax wire pairs.

2. Description of the Related Art

The Quad Small Form-Factor Pluggable (QSFP) connector is a connector capable of achieving a 40 Gb/s data rate (QDR, quad data rate, with the governing standards specifying a bandwidth of approximately 5 GHz) using InfiniBand, Ethernet, or other networking protocols. To achieve these high data rates, particularly with respect to 40 Gb/s Ethernet, crosstalk between the differential pairs within the connector must be reduced. Reducing crosstalk allows for a higher signal-to-noise ratio and reduces the amount of processing needed to achieve these higher data rates.

A QSFP cable assembly is a twin-ax cable with a QSFP connector module attached to both ends. The cable generally has eight twin-ax differential pairs (four transmit and four receive) with a drain wire for each pair. Each of the sub-cables (differential pair conductors and respective drain wire) typically has a conductive foil which is in contact with the drain wire, and there typically is a braided conductive shield around the eight sub-cables. A printed circuit board (PCB) in each connector is attached to the cable's differential pairs at the respective ends of the cable assembly, with four differential pairs and their respective drain wires connected to PCB terminals on one side of the PCB. The other four differential pairs and their respective drain wires are connected to PCB terminals on the other side of the PCB. The PCB terminals that connect to the drain wires are connected to ground planes in the PCB with vias (plated through holes) in the PCB.

One method of connecting the drain wire to the PCB is to attach it directly to the PCB by way of shaping the drain wire so that it bends around and ends up lying next to one of the differential pair wires, as shown in FIG. 1. Some problems that arise from this termination method include that the drain wire is attached to the PCB next to only one of its differential pair signal conductors which creates an unsymmetrical relationship between the ground (drain wire) and its differential pair signal conductors. Having a non-symmetric relationship between two conductors of a differential pair and ground can lead to common mode generation which ultimately creates crosstalk.

U.S. Patent Application Publication 2010/0029104, incorporated by reference as if fully set forth herein, describes a SFP+ (small form-factor pluggable) connector pair manager for use in securing a twin-axial cable to a connector printed circuit board. The pair manager provides a symmetric termination between two conductors of a differential pair and the drain wire/ground. However, the SFP+ (small form-factor pluggable) connector typically includes only two twin-ax terminations on one side of the SFP+ connector PCB.

Currently for a QSFP connector the maximum twin-ax cable outer diameter that can fit into it is a cable where the individual signal conductors are 24 AWG, although 24-30 AWG are used for different lengths of cable assemblies, and smaller than 30 AWG are also acceptable. A typical goal for QSFP cable assemblies is that for a given length, (maximum currently 7 meters for 40 Gb/s Ethernet, 5 to 6 meters for InfiniBand) the minimum wire size should be used while still meeting the insertion loss requirements. The form factor for the QSFP connector is set by the SFF-8436 standard, and one challenge with respect to fitting the cable into the connector is that it can be difficult to fit 24 AWG cable, which is used for the longer reach cable assemblies.

SUMMARY OF THE INVENTION

The invention comprises, in one form thereof, an electrical connector with a first shell, an opposing second shell connected to the first shell, and a circuit board connected between the first shell and the second shell. The circuit board has a first side and an opposing second side and includes a plurality of differential pair conductive traces on each of the first side and the second side. A first drain wire termination device is positioned along first side approximately at the differential pair conductive traces, and more particularly approximately where the differential wire pairs are connected to the traces, and includes at least one separator positioned above and between at least one of the differential pair conductive traces on the first side and another of the differential pair conductive traces on the first side. A second drain wire termination device is positioned along the second side approximately at the differential pair conductive traces and includes at least one separator positioned above and between at least one of the differential pair conductive traces on the second side and another of the differential pair conductive traces on the second side.

The invention comprises, in another form thereof, a cable assembly with a twin-ax cable which has a plurality of differential conductor pairs where each of the differential conductor pairs includes a corresponding drain wire. An electrical connector is connected to the twin-ax cable. The electrical connector includes a first shell, an opposing second shell connected to the first shell, and a circuit board positioned between the first shell and the second shell. The circuit board has a first side and an opposing second side and a plurality of differential pair conductive traces on each of the first side and the second side. The plurality of differential pair conductive traces are connected to corresponding pairs of the plurality of differential conductor pairs. A first drain wire termination device is connected to the first side approximately at the differential pair conductive traces and includes at least one separator between at least one of the differential pair conductive traces on the first side and another of the differential pair conductive traces on the first side. The first drain wire termination device is connected to at least one drain wire on the first side. A second drain wire termination device is connected to the second side approximately at the differential pair conductive traces and includes at least one separator between at least one of the differential pair conductive traces on the second side and another of the differential pair conductive traces on the second side. The second drain wire termination device is connected to at least one drain wire on the second side.

The invention comprises, in yet another form thereof, an electrical connector which includes a first shell, an opposing second shell connected to the first shell, and a circuit board positioned between the first shell and the second shell. The circuit board has a first side and an opposing second side and includes a plurality of differential pair conductive traces on at least one of the first side and the second side. At least one drain wire termination device is connected to at least one of the first side and the second side. At least one drain wire termination device includes at least one separator between at least one of the differential pair conductive traces and another of the differential pair conductive trace. At least one separator has a flexible joint.

The invention comprises, in yet another form thereof, a cable assembly which includes a twin-ax cable with a plurality of differential conductor pairs, where each of the differential conductor pairs includes a corresponding drain wire, and an electrical connector connected to the twin-ax cable. The electrical connector includes a first shell, an opposing second shell connected to the first shell, and a circuit board connected between the first shell and the second shell. The circuit board has a first side and an opposing second side and a plurality of differential pair conductive traces on at least one of the first side and the second side. The plurality of differential pair conductive traces are connected to respective ones of the differential conductor pairs. At least one drain wire termination device is connected to at least one of the first side and the second side and includes at least one separator between at least one of the differential pair conductive traces and another of the differential pair conductive traces. At least one of the separators has a flexible joint.

The invention comprises, in yet another form thereof, a method of terminating an electrical connector to a twin-ax cable. The method includes the steps of: trimming insulation from differential conductive pairs and respective drain wires of the twin-ax cable; connecting the differential conductive pairs to a side of a printed circuit board of the electrical connector; separating at least one of the differential conductive pairs from another of the differential conductive pairs with a drain wire termination device; placing the drain wires on the drain wire termination device, each of the drain wires being arranged symmetrically with respect to its corresponding differential conductive pair; terminating the drain wires to the drain wire termination device; and minimizing crosstalk between the differential conductive pairs.

An advantage of at least one embodiment of the present invention is that it reduces crosstalk in a high data connector/cable assembly.

Another advantage of at least one embodiment of the present invention is that it can accommodate a range of twin-ax wire sizes.

Yet another advantage of at least one embodiment of the present invention is that it is relatively easy to manufacture.

Yet another advantage of at least one embodiment of the present invention is that it is reliable in use.

BRIEF DESCRIPTION OF THE DRAWINGS

Corresponding reference characters indicate corresponding parts throughout the several views. The exemplifications set out herein are not to be construed as limiting the scope of the invention in any manner.

DESCRIPTION OF THE INVENTION

Embodiments of the present invention include an improved high data rate connector and cable assembly, and a method of minimizing the crosstalk therein. It was discovered that the NEXT crosstalk issues of the prior art primarily arise because of the way the twin-ax cable is terminated in the prior art (see FIG. 1, for example), where the drain wire is bent around the signal conductors and soldered to the PCB on one side of the signal conductors.

Figure 2:
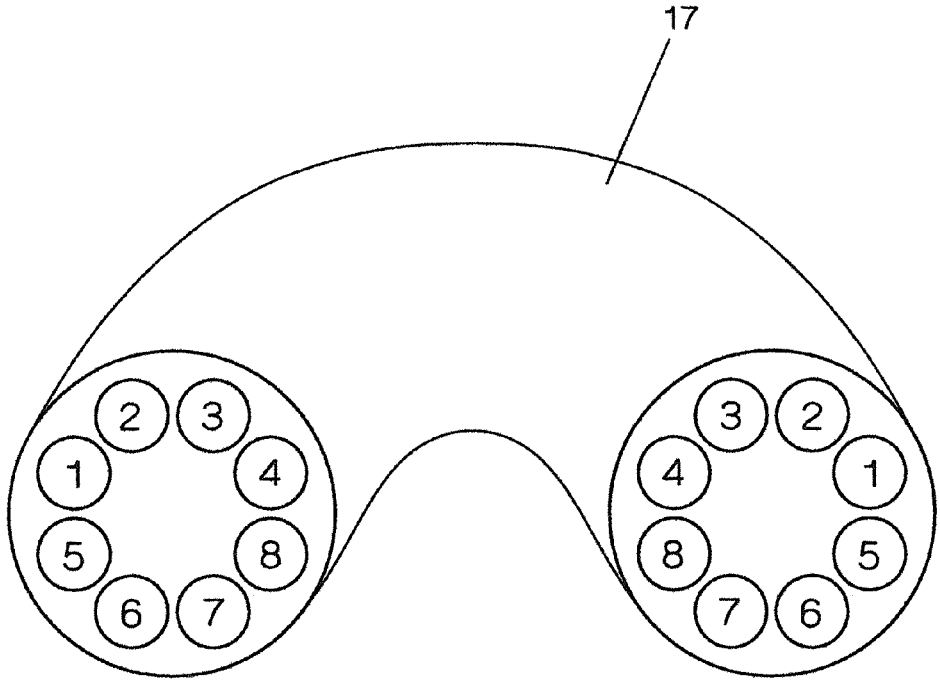
FIG. 2 is a schematic view of the two ends of an eight-channel twin-ax cable illustrating the relative locations of the channel sub-cables at the cable ends.

In some embodiments of the present invention, two ends of an eight-channel (eight sub-cables each having differential pair conductors and a respective drain wire) twin-ax cable typically present mirror images of the sub-cables as shown in FIG. 2. Although the connectors at either end of the cable assembly have essentially the same outward appearance and can fulfill the form factor requirements of the SFF-8436 standard created by the InfiniBand Trade Association, they have two different PCBs at either end of the cable assembly in order to avoid twisting of the sub-cables during termination of the cable to the PCBs.

In the embodiment shown, each of the PCBs of the present invention has four conductive layers separated by three dielectric layers. The four conductive layers of the first PCB are shown in FIGS. 3-6, and the four conductive layers of the second PCB are shown in FIGS. 7-10. The orientation of the views of FIGS. 3-6 and FIGS. 7-10 are shown in a "see through" mode, i.e., these are the orientations if an observer was looking at one side of the PCB and could see through the various layers. These boards are four-layer boards which have an overall thickness of about 0.0398". The top layer is ½ oz plated copper, the inner layers are ½ oz copper, and the bottom layer is ½ oz plated copper. The top and bottom layers are separated from the inner layers by 0.014" and the inner layers are separated from each other by 0.007". FR4 material can be used for the layers, each having a dielectric constant of approximately 4.4. The requirements of the SFF-8436 and IEEE 802.3ba 40 Gb/s Ethernet standard dictate that each channel (sub-cable) operates in half-duplex communication mode. Consequently, each of the PCBs of the present invention includes four transmit channels, TX1, TX2, TX3, and TX4, and four receive channels RX1, RX2, RX3, and RX4. The transmit channels TX1-TX4 in the first connector (using a PCB with the layouts shown in FIGS. 3-6) are connected to the receive channels RX1-RX4 channels in the second connector (using a PCB with the layouts shown in FIGS. 7-10), respectively; and the receive channels RX1-RX4 channels in the first connector are connected to the transmit channels TX1-TX4 in the second connector, respectively.

Figure 3:
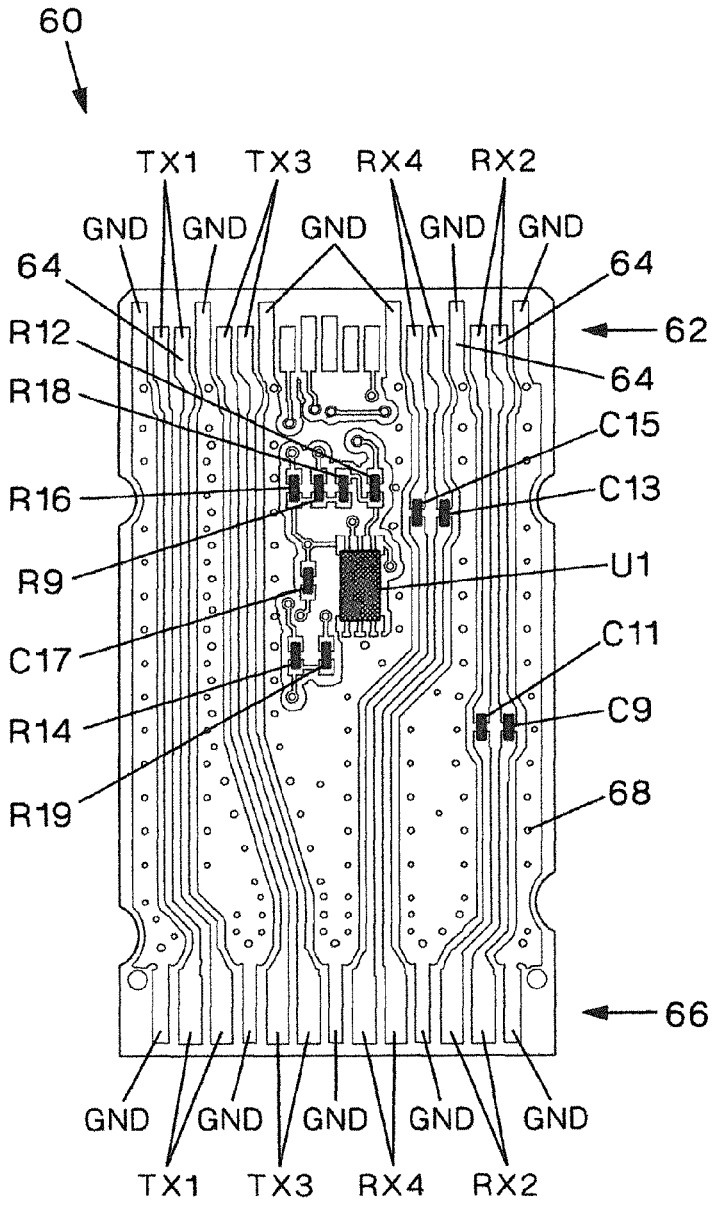
FIG. 3 is a top view of a first outer layer of a QSFP connector PCB used on one end of the cable assembly according to the present invention.

Referring to FIG. 3, there is shown a top view of a first outer layer 60 of a QSFP connector PCB used in one of the connectors of the cable assembly according to the present invention. QSFP device end 62 of layer 60 includes gold plated terminals 64 which are per the SFF-8436 standard. Twin-ax cable end 66 of layer 60 is configurable. The transmit channels on layer 60 have reference characters TX1-TX4 associated therewith; and the receive channels on layer 60 have reference characters RX1-RX4 associated therewith. The ground terminals and traces are indicated with the reference character GND. Vias 68 (plated through holes) interconnect the conductive ground planes/traces of the various layers, and there are one hundred to one hundred fifty vias 68 shown in FIG. 3.

The first inner layer 70 (FIG. 4) has a conductive ground plane 72 with QSFP device end 74 and twin-ax cable end 76. The second inner layer 80 (FIG. 5) has a conductive ground plane 82 with QSFP device end 84 and twin-ax cable end 86. Ground planes 72 and 82 are connected to GND traces on outer layer 60 via plated through holes 68 and plated through holes (not shown) in ground planes 72 and 82.

Figure 4:
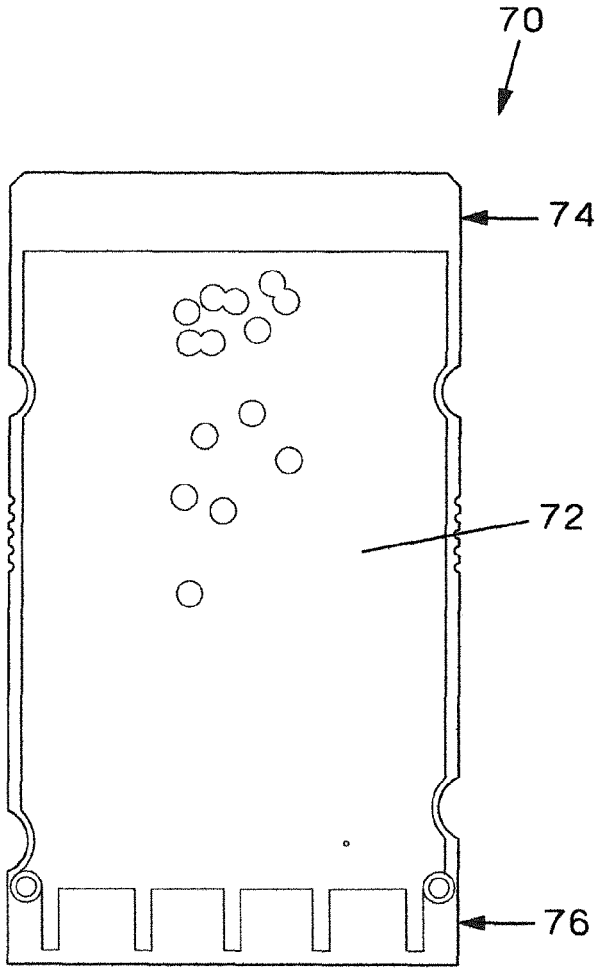
FIG. 4 is a top view of a first inner layer of the QSFP connector PCB of FIG. 3.
Figure 5:
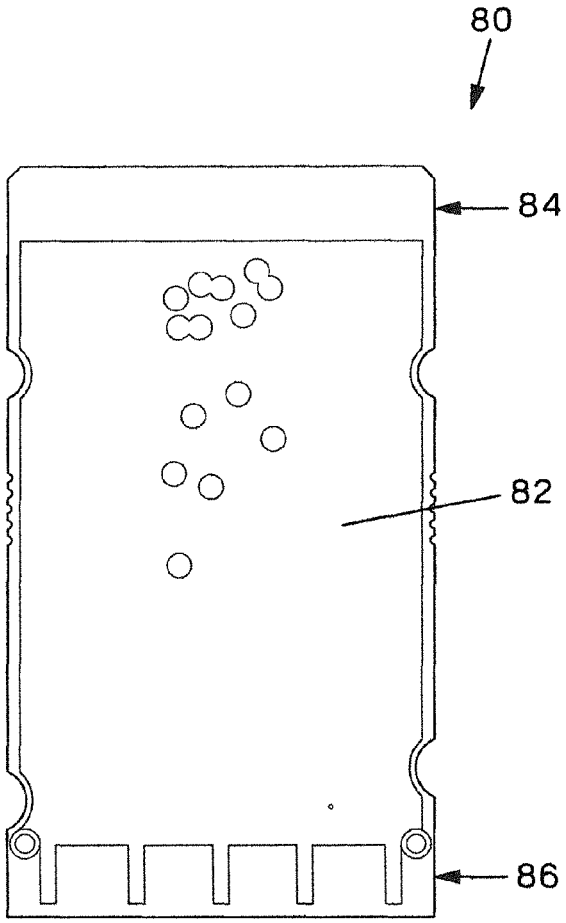
FIG. 5 is a top view of a second inner layer of the QSFP connector PCB of FIG. 3.
Figure 6:
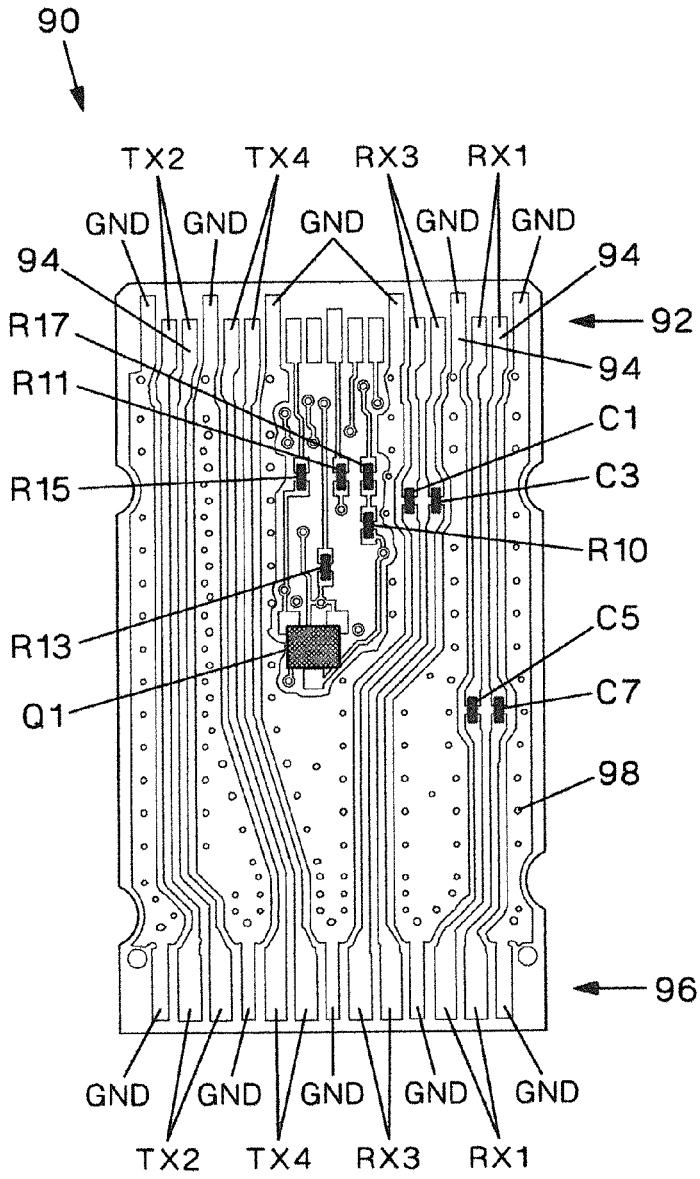
FIG. 6 is a top view of a second outer layer of the QSFP connector PCB of FIG. 3.

Referring to FIG. 6, there is shown a top view of a second outer layer 90 used in the same PCB as FIGS. 3-5. QSFP device end 92 of layer 90 includes gold plated terminals 94 which are per the SFF-8436 standard. Twin-ax cable end 96 of layer 90 is configurable. The transmit channels on layer 90 have reference characters TX1-TX4 associated therewith; and the receive channels on layer 90 have reference characters RX1-RX4 associated therewith. The ground terminals and traces are indicated with the reference character GND. Vias 98 (plated through holes) interconnect the conductive ground planes/traces of the various layers including vias 68 on layer 60, and there are one hundred to one hundred fifty vias 98 shown in FIG. 6.

Figure 7:
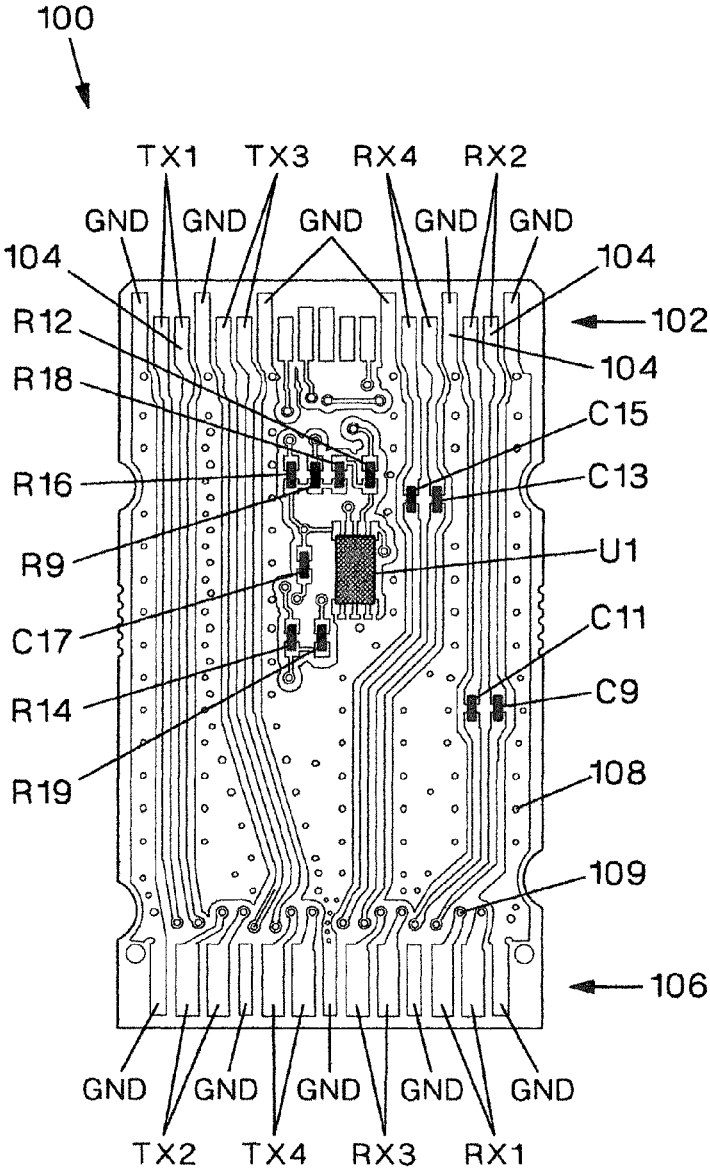
FIG. 7 is a top view of a first outer layer of a QSFP connector PCB used on another end of the cable assembly according to the present invention.

The PCB for the other end of the cable assembly is shown in FIGS. 7-10. Referring to FIG. 7, there is shown a top view of a first outer layer 100 of a QSFP connector PCB used in another of the connectors of the cable assembly according to the present invention. QSFP device end 102 of layer 100 includes gold plated terminals 104 which are per the SFF-8436 standard. Twin-ax cable end 106 of layer 100 is configurable. The transmit channels on layer 100 have reference characters TX1-TX4 associated therewith; and the receive channels on layer 100 have reference characters RX1-RX4 associated therewith. The ground terminals and traces are indicated with the reference character GND. Vias 108 (plated through holes) interconnect the conductive ground planes/traces of the various layers, and there are one hundred to one hundred fifty vias 108 shown in FIG. 7.

First inner layer 110 (FIG. 8) has a conductive ground plane 112 with QSFP device end 114 and twin-ax cable end 116. Second inner layer 120 (FIG. 9) has a conductive ground plane 122 with QSFP device end 124 and twin-ax cable end 126. Ground planes 112 and 122 are connected to GND traces on outer layer 100 via plated through holes 108 and plated through holes (not shown) in ground planes 112 and 122.

Figure 8:
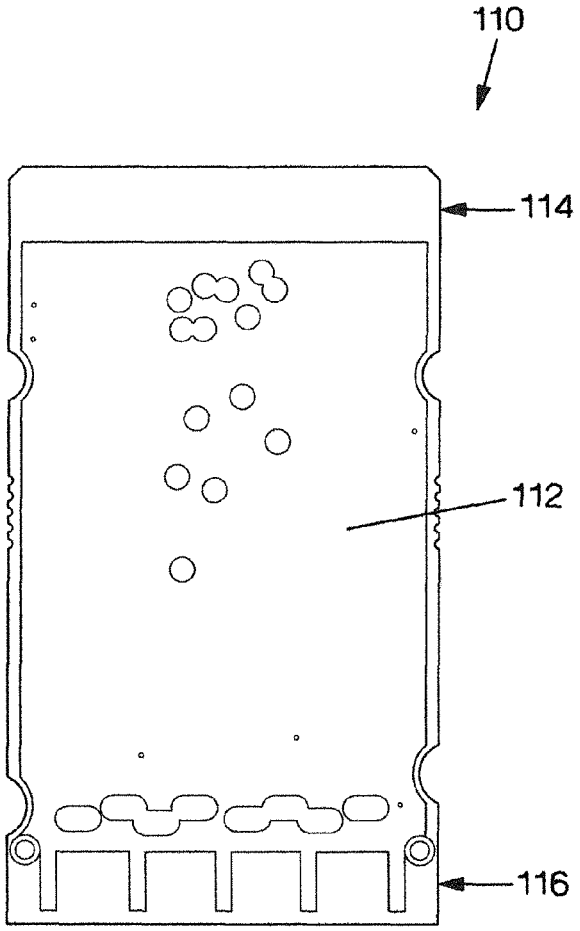
FIG. 8 is a top view of a first inner layer of the QSFP connector PCB of FIG. 7.
Figure 9:
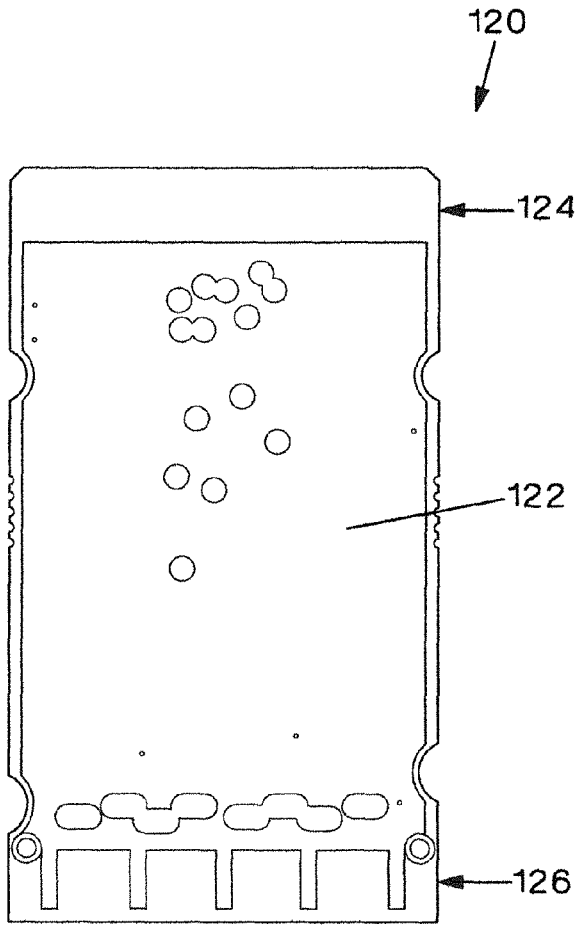
FIG. 9 is a top view of a second inner layer of the QSFP connector PCB of FIG. 7.
Figure 10:
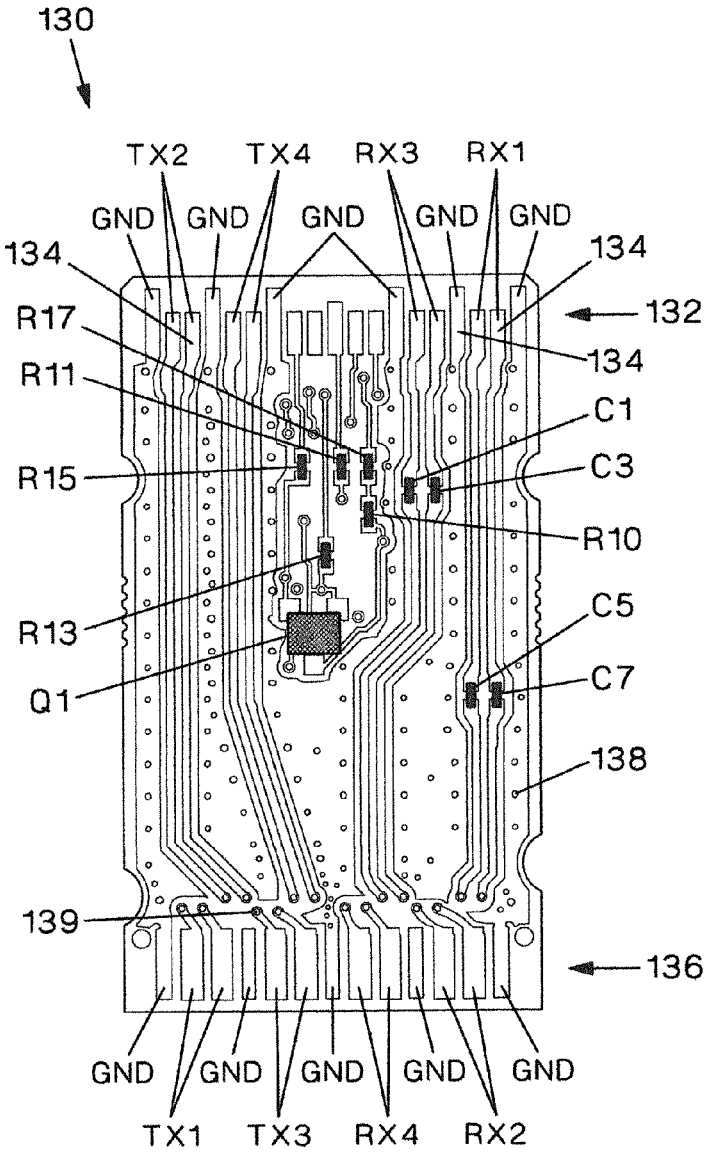
FIG. 10 is a top view of a second outer layer of the QSFP connector PCB of FIG. 7.

Referring to FIG. 10, there is shown a top view of a second outer layer 130 used in the same PCB as FIGS. 7-9. QSFP device end 132 of layer 130 includes gold plated terminals 134 which are per the SFF-8436 standard. Twin-ax cable end 136 of layer 130 is configurable. The transmit channels on layer 130 have reference characters TX1-TX4 associated therewith; and the receive channels on layer 130 have reference characters RX1-RX4 associated therewith. The ground terminals and traces are indicated with the reference character GND. Vias 138 (plated through holes) interconnect the conductive ground planes/traces of the various layers including vias 108 on layer 100, and there are one hundred to one hundred fifty vias 138 shown in FIG. 10.

Figure 11:
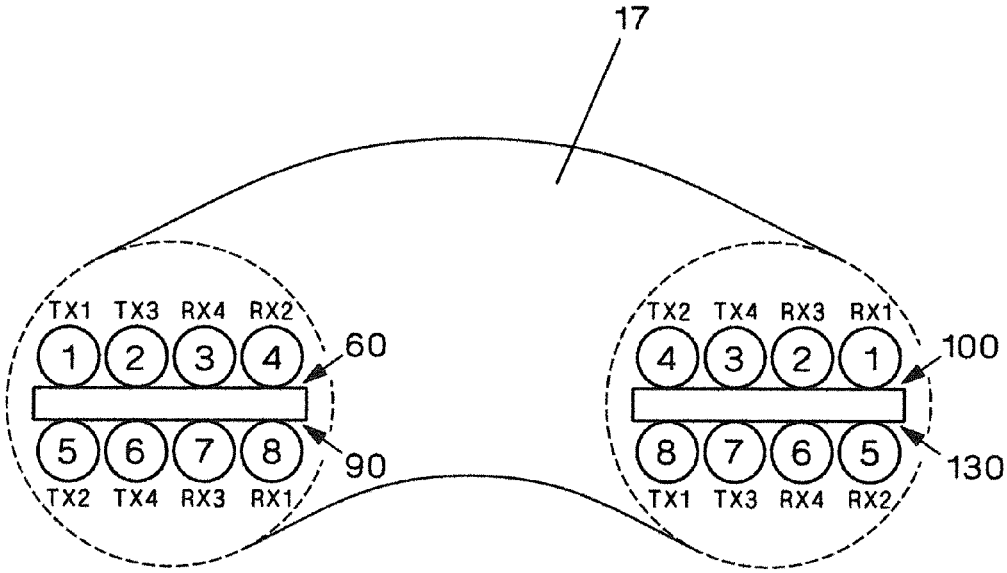
FIG. 11 is a schematic view of the two ends of an eight-channel twin-ax cable assembly illustrating the relative locations of the channel sub-cables at the cable ends when PCBs having the layouts of FIGS. 3-6 and 7-10 are attached thereto.

In addition to the plated through holes and vias 108 and 138, a PCB using the conductive layers shown in FIGS. 7-10 will include vias 109 and 139, which swap the position of the TX and RX terminals to be consistent with the mirrored ends of the cable shown in FIG. 2. The resultant improvement in the sub-cable/channel layout is shown schematically in FIG. 11, where now the wires of the cable shown in FIG. 2 can attach to both connector ends without any twisting, because the connector PCB at both ends conforms to the natural layout of sub-cables 1-8. This invention simplifies the assembly process by reducing the amount of cable manipulation when terminating QSFP cable assemblies. This result produces cable assemblies with lower manufacturing costs, along with less chance for electrical degradation during assembly, and improved reliability.

For both PCBs of FIGS. 3-6 and FIGS. 7-10, the top and bottom layers contain four receive (RX) lanes and four transmit (TX) lanes (RX1-RX4, TX1-TX4). Each lane includes a differential pair designed to have an impedance of 100 ohms, which is determined by the distributed electrical characteristics of the channels, and is influenced by the dielectric layers' thicknesses and material, and the conductive traces' geometries and materials. The channels serve to connect the twin-ax cable to its corresponding mating socket. This socket connection occurs at the gold fingers (on one edge of the circuit board, they appear staggered in length). The location and dimensions of these gold fingers are specified in the SFF-8436 standard.

Additionally, the QSFP PCBs has several discrete circuit elements attached to them. Such elements include the DC blocking capacitors attached to each RX lane between the twin-ax cable and the gold fingers (C1, C3, C5, C7, C9, C11, C13, and C15). These capacitors are required per both the SFF-8436 standard and the IEEE 802.3ba 40 Gb/s Ethernet standard. These capacitors are generally a 0.01 μF or a 0.1 μF capacitor, but any capacitor will work, provided the capacitor has approximately 0 dB of insertion loss between 100 and 5000 MHz, and does not let DC signals pass through.

The other circuit elements (C17, R9, R10, R11, R12, R13, R14, R15, R16, R17, R18, R19, Q1, and U1) are there to provide information to an attached device confirming what the QSFP cable assembly is (e.g., indicator that the connector is present, an indication as to whether the connector is copper or fiber). The SFF-8436 standard has requirements as to how the connector identifies itself to what it is mated to, and these circuit elements serve to meet these requirements (accomplished by pulling a contact low or high through the use of resistors (R), or by providing information from the EEPROM (U1), Q1 is a transistor that acts to turn U1 off and on).

The functionality of the PCBs of FIGS. 3-6 and FIGS. 7-10, except for the flipping of the position of the TX and RX terminals as previously described for manufacturability, are identical and these PCBs are used as pairs in connectors on either end of the cable assembly according to the present invention. A cable assembly according to some embodiments of the present invention can use connectors with identical PCBs on either end of the cable assembly; however, this may present problems as previously described.

The layout of the QSFP PCB for the region where the twin-ax cable attaches to it is primarily responsible for causing "direct" NEXT coupling where one wire of a differential pair is coupling more to one wire of another differential pair. This is the standard type of differential NEXT coupling, and is influenced primarily by the proximity of neighboring wires as they attach to the circuit board.

The crosstalk improvement of the present invention minimizes both the direct crosstalk coupling ($NEXT_{direct}$, where a differential signal is directly coupled from one differential pair to another differential pair), and "indirect" crosstalk coupling caused by differential to common mode conversions and common mode coupling. The physical structure of the twin-ax cable coupled with the termination method of FIG. 1 onto the prior art QSFP PCB causes "indirect" NEXT coupling. Indirect NEXT coupling starts with an imbalance between one of the wires of one differential pair and ground (essentially one wire sees more or less of ground than the other wire). The imbalance to ground creates a differential to common mode conversion on that differential pair. This common mode signal then couples to a neighboring differential pair. A similar imbalance in the second differential pair creates a common to differential mode conversion. Thus, a differential to differential NEXT coupling occurs via this indirect path ($NEXT_{indirect}$) through common mode conversion and coupling. This can be understood for a given channel pair (channel 1 and channel 2, for example) by equation (1) which, in logarithmic terms, states:

$$NEXT_{indirect}=DMCM_{Channel\ M}+CMCM_{Channel\ M\ coupling\ to\ Channel\ N}+CMDM_{Channel\ N} \quad \text{eq. (1)}$$

where $DMCM_{Channel\ M}$ refers to a differential to common mode conversion in channel M (M can be 1 through 4), $CMCM_{Channel\ M\ coupling\ to\ Channel\ N}$ refers to common mode coupling between channel M and N (M and N both be 1 through 4), and $CMDM_{Channel\ N}$ refers to common mode to differential mode coupling in channel N (N can be 1 through 4).

Therefore, the overall NEXT response of a connector ($NEXT_{connector}$) for a given pair combination is given by:

$$NEXT_{connector}=NEXT_{direct}+NEXT_{indirect}. \quad \text{eq. (2)}$$

Each lane (two signal conductors plus one drain wire) in a QSFP cable assembly is half duplex in that it transmits information in only one direction. Referring to one end of the cable assembly, there are four transmit (TX) lanes and four receive (RX) lanes. Crosstalk within a QSFP cable assembly is measured between a TX lane and a RX lane. NEXT is measured from a TX to an RX lane on one end of a QSFP cable assembly. FEXT is measured from a TX to RX lane across a QSFP cable assembly.

One end of a QSFP connector is gold plated fingers (terminals, QSFP device end) on the top and bottom layers. This region satisfies the SFF-8436 specification. This edge has TX3/RX3 spaced adequately from RX4/TX4, respectively. However, on the other end of the circuit board where the twin-ax wires attach, TX3/RX3 is very near RX4/TX4. This proximity creates problems with direct NEXT coupling. This area is not called out per the standard and can be modified under the standard. However, the major constraint in this region is space, as the circuit board cannot be widened due to the fact it must fit within the metallic connector. Therefore, for the given geometry, there is a limit as to how far apart these wires can be. The present invention reduces direct NEXT coupling by providing a path to ground within the region between the neighboring wires.

Figure 1:
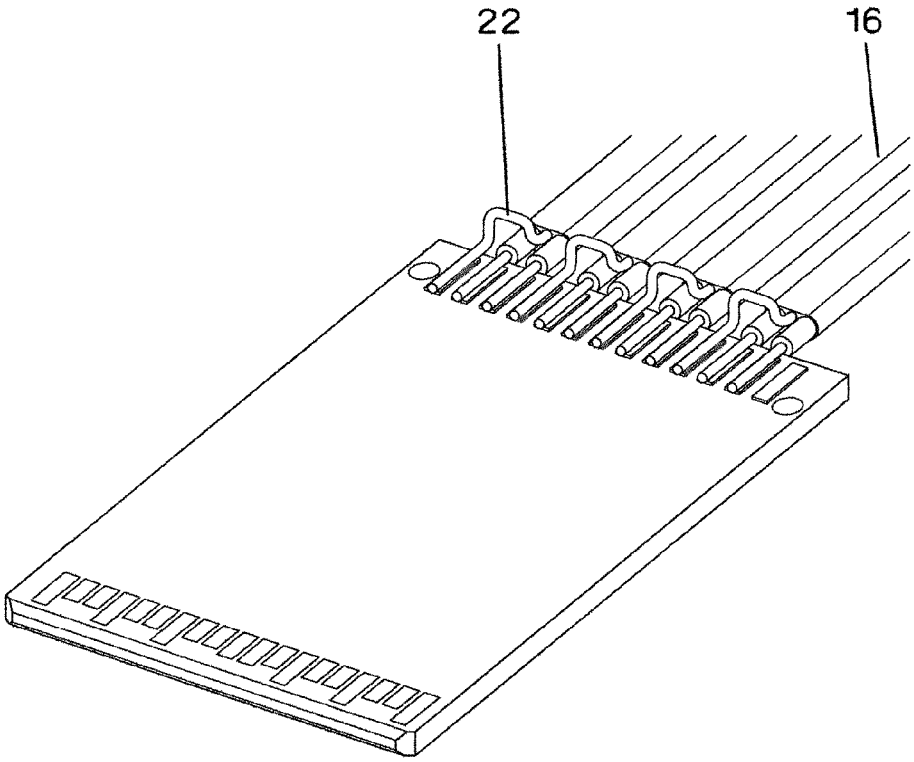
FIG. 1 is a perspective view of a prior art QSFP connector PCB termination to the twin-ax wire pairs.

While providing a symmetrical path to ground for both signal conductors of a given differential pair addresses direct NEXT, this symmetry also helps address indirect NEXT by reducing the common mode generation. The reason common mode generation must be reduced is that additional spacing or a path to ground that reduces direct NEXT coupling will not help nearly as much with indirect NEXT coupling. A path to ground that does not completely isolate a given conductor is not as effective against common mode signals, and spacing does not give as much benefit with common mode coupling as it does with the differential mode coupling of direct NEXT. Thus, to address indirect NEXT, the common mode source must be addressed. Common mode signals are typically created by an imbalance in coupling between the conductors of a differential pair and ground. The cause of this imbalance within a QSFP connector is primarily in the termination method of the drain wire to the circuit board. A typical twin-ax cable is very well balanced with respect to each signal conductor and the drain wire. However, if one terminates the cable similar to the method shown in FIG. 1, one creates a termination region which is imbalanced with respect to the drain wire and the two different signal conductors (one is closer than the other to the terminated drain wire) and this imbalance can generate common mode signals. Additionally, the very act of bending the drain wire around so that it can mate with the PCB as shown in FIG. 1 can cause an imbalance when the wire is wrapping around a given signal conductor (and not the other). The present invention overcomes the limitations of the prior art and provides a termination method that can balance the signal conductors with respect to the drain wire.

Figure 12:
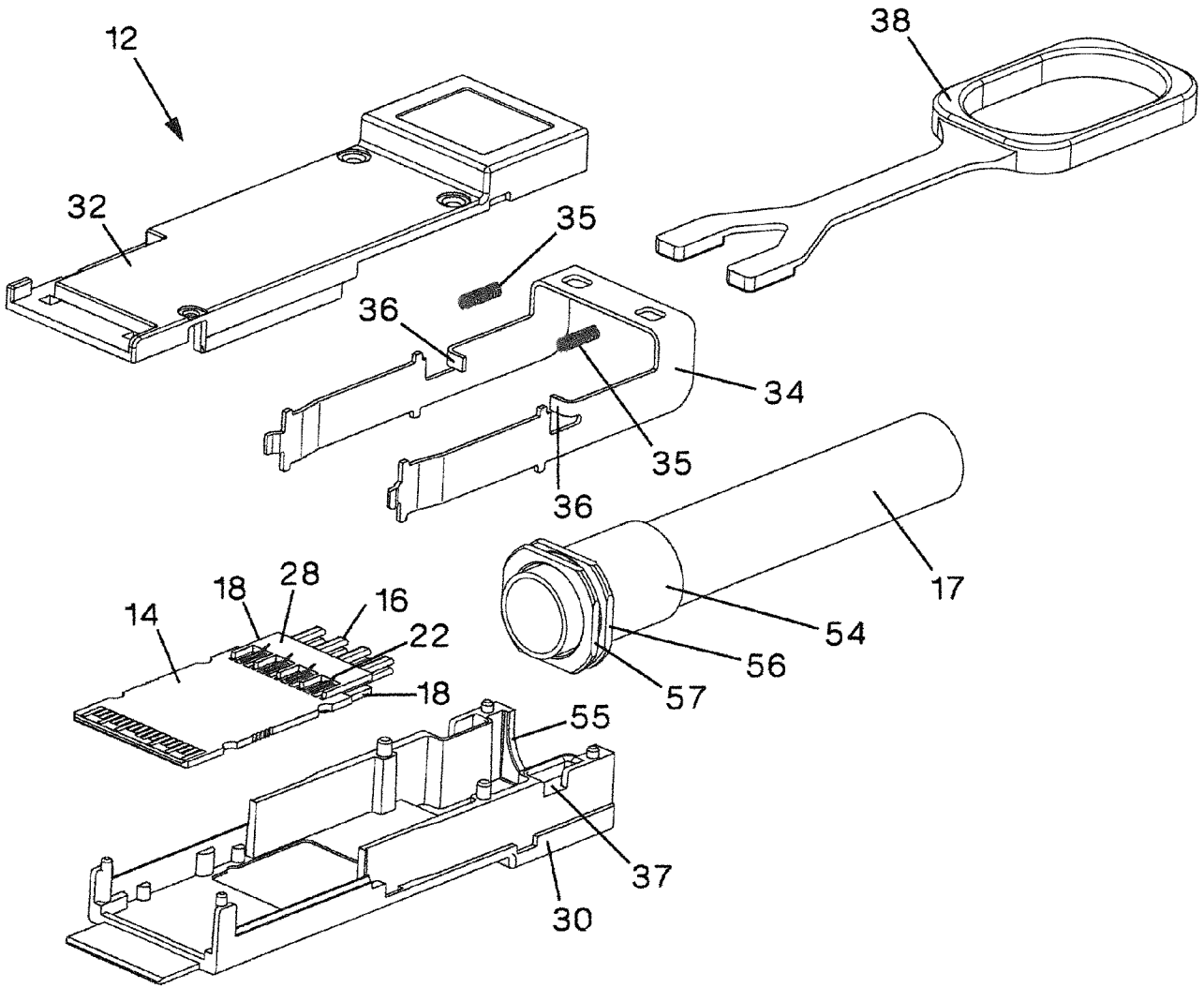
FIG. 12 is an exploded perspective fragmentary view of an embodiment of a connector and cable assembly according to the present invention.
Figure 13:
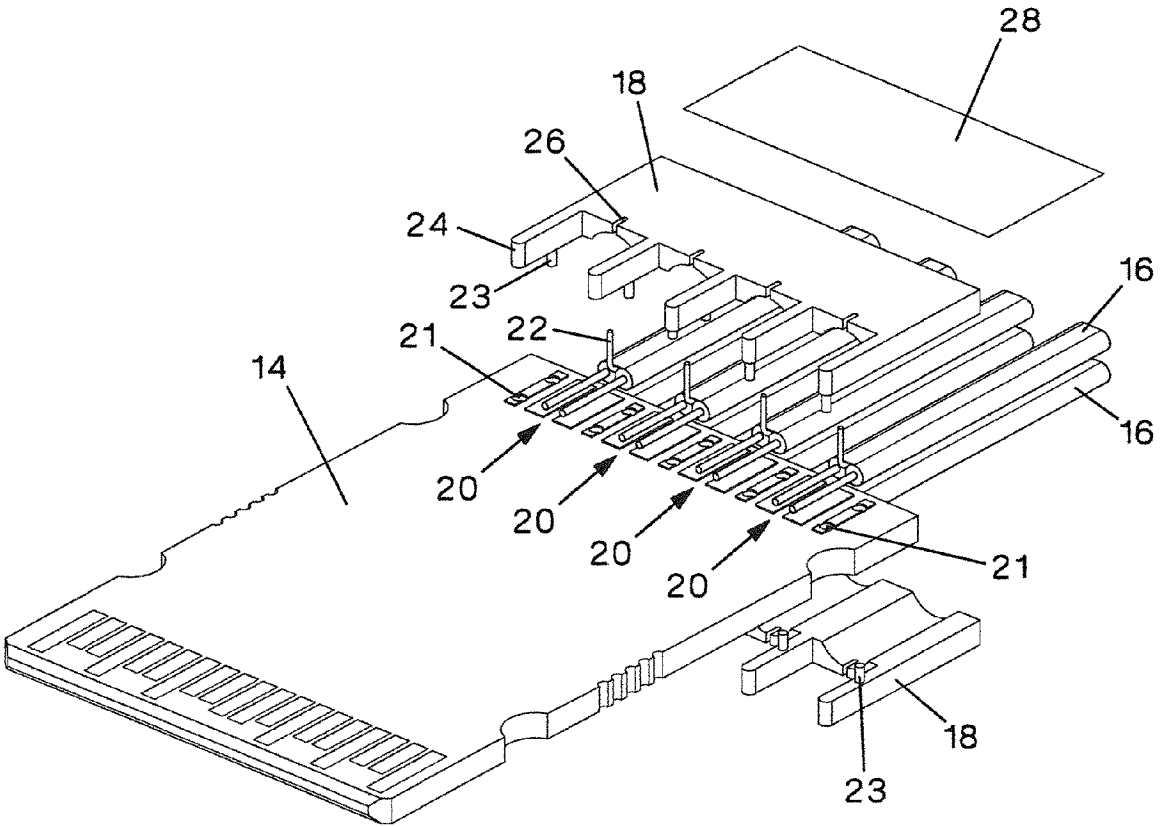
FIG. 13 is an exploded perspective detail view of the connector, PCB, and drain wire termination devices of FIG. 12.
Figure 14:
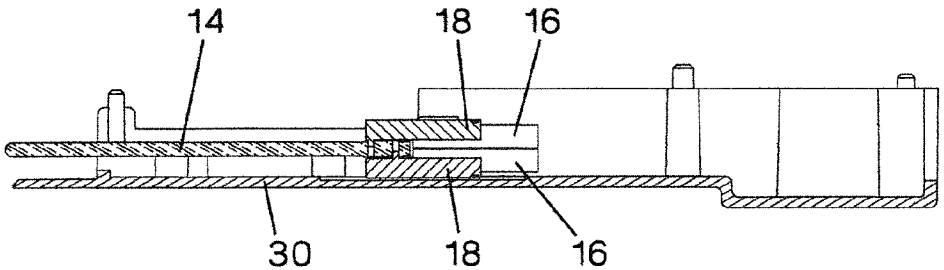
FIG. 14 is a cross-sectional view of the connector bottom shell PCB, and drain wire termination devices of FIG. 12.

One embodiment of a QSFP connector cable assembly 12 is shown in FIG. 12. Drain wire termination devices 18 are attached to the PCB 14, and twin-ax wires 16 of eight-channel twin-ax cable 17 pass through them. Top shell 32 and bottom shell 30 enclose the PCB 14 and drain wire termination device 18. Crimp ring 54 provides strain relief for the typically soldered connections between twin-ax wires 16 and the traces on PCB 14, and provides a low electrical resistance connection between shells 30 and 32 and the braided shield (not shown) of cable 17. Flange 55 of shell 30, and similar structure on shell 32, is placed between wall 56 and wall 57 of crimp ring 54 during assembly of the cable to the connector. The PCB 14 can include the circuitry of either FIG. 3-6 or 7-10. An enlarged view of the drain wire termination device 18 is shown in FIG. 13. Latch 34 is biased in a closed position with springs 35 in contact with tabs 36. Springs 35 are held in slots 37. Pull tab 38 connects to latch 34. Signal conductor pairs 20 are isolated from one another by fins 24 on the drain wire termination device 18. Drain wires 22 are pulled back into slots 26 and are attached to the drain wire termination device 18 by way of copper tape 28. Other ways of attachment, such as soldering, are also possible. Drain wire termination device 18 can be a die-cast part, a stamped part, a machined part, or other. FIG. 14 shows a cross-sectional side view of a QSFP connector that incorporates the drain wire termination devices 18. In this embodiment the drain wire termination devices 18 can be press fit into holes 21 in PCB 14 using locators 23.

Figure 15:
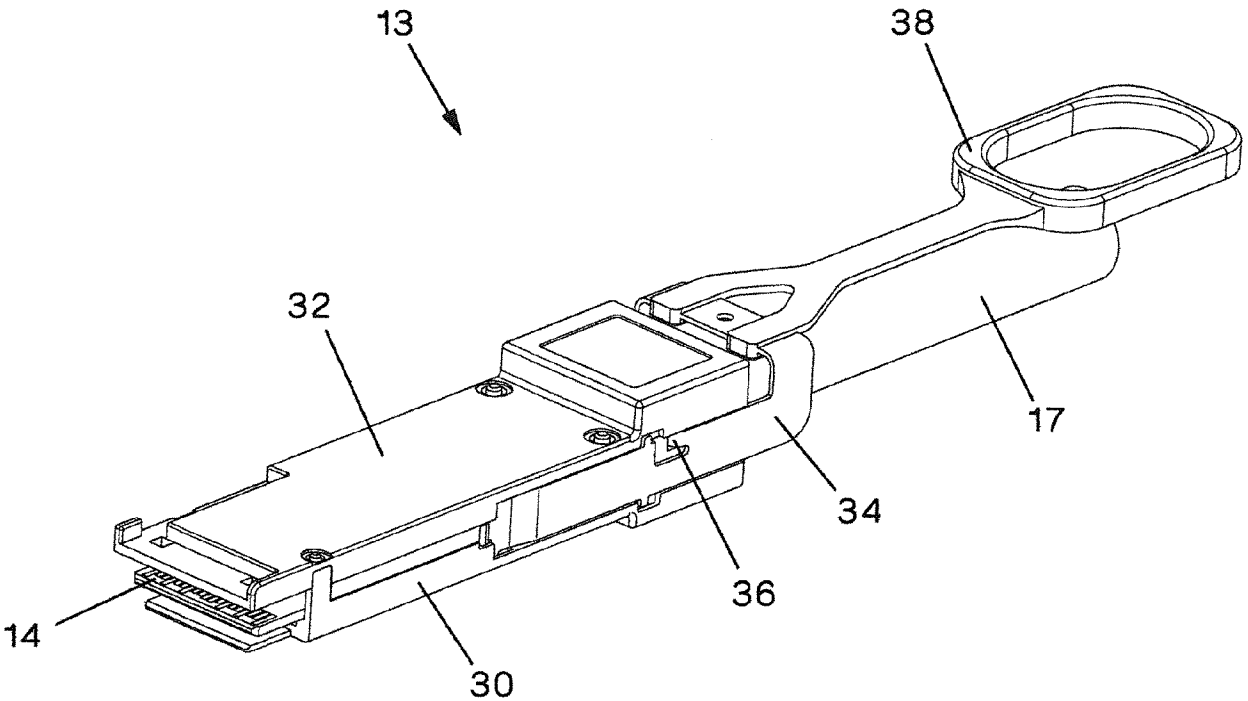
FIG. 15 is a fragmentary perspective view of a another embodiment of a connector/cable assembly according to the present invention.
Figure 16:
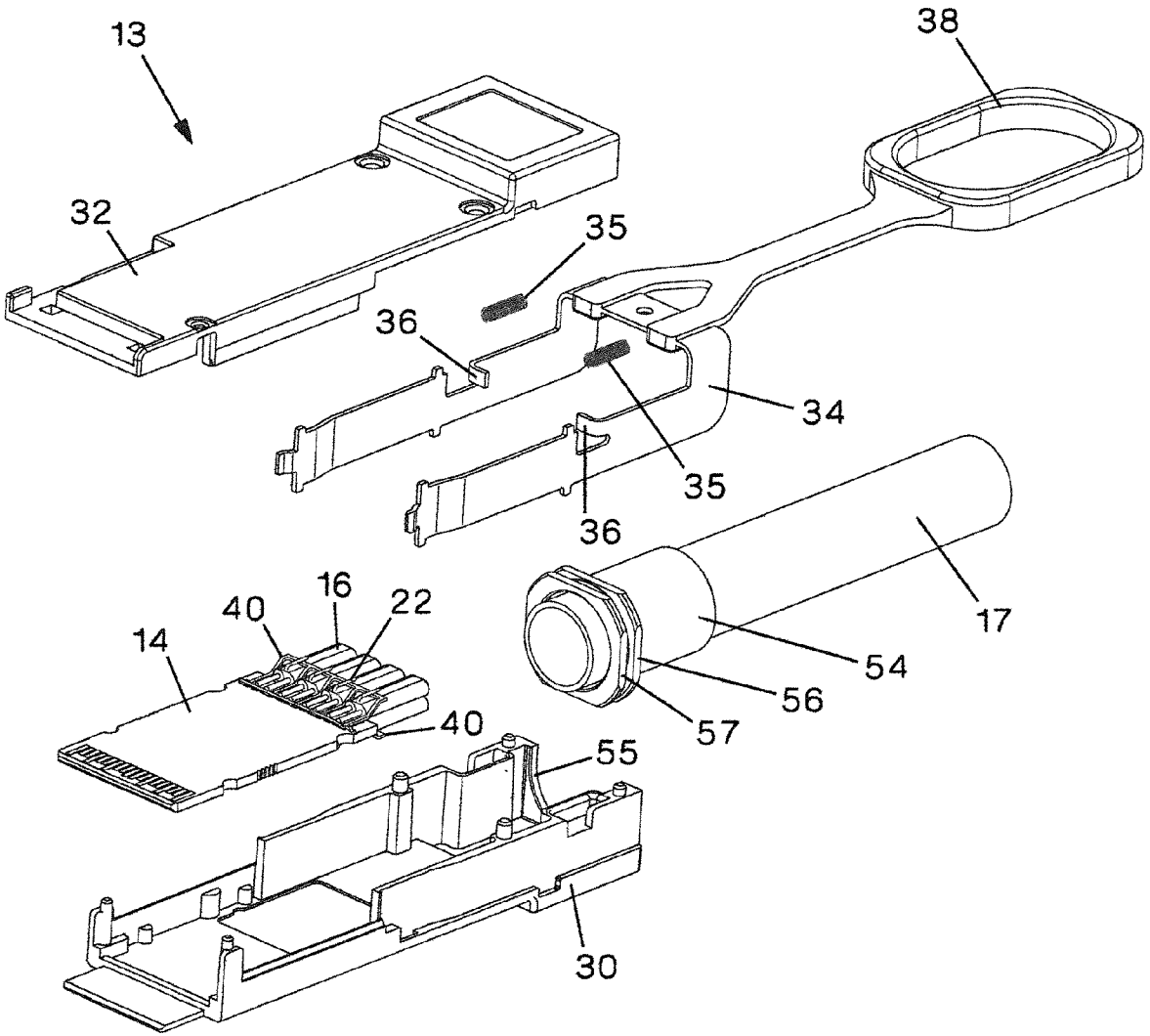
FIG. 16 is an exploded perspective view the connector/cable assembly of FIG. 15.

FIG. 15 is a perspective view of a QSFP connector 13 according to one embodiment of the present invention. The QSFP connector and cable assembly device, and the method of reducing the crosstalk (near-end (NEXT) or far-end (FEXT)), according to the embodiment of FIG. 15 uses the drain wire termination device 40 shown in FIGS. 16-19. An exploded view of the QSFP cable assembly 13 is shown in FIG. 16. As with device 18, this drain wire termination device 40 provides shielding between different differential pairs and symmetric termination of the drain wire and signal conductors. That is, the electrical connection between the drain wire associated with each differential pair and the drain wire termination device is symmetrically disposed between the individual conductors of the associated differential conductors. This symmetrical termination significantly reduces crosstalk generation as a result of differential mode to common mode conversion.

The drain wire termination device 40 has fins 42 (shown in FIG. 19 and similar to fins 24 on drain wire termination device 18) that achieve isolation between neighboring wires and symmetric termination for each signal conductor to ground. The drain wire termination device 40 is provided with a drain wire attachment area 44, which is where the drain wires 22 are pulled back and attached. In one embodiment of the connector, the drain wires 22 are soldered to the drain wire attachment locations 44. The drain wire termination device 40 also has tabs 46 that mate with corresponding holes 47 in PCB 14 (as shown in FIG. 7) that help position the termination device 40 on PCB 14. A reinforcement bar 48 runs along the front of the drain wire termination device 40, helping to maintain the structural integrity of the drain wire termination device from fabrication to termination. Drain wire termination device 40 is typically a stamped part (versus typically a die cast part for drain wire termination device 18). The preferred thickness of the drain wire termination device 40 is 0.014", but can range from 0.010"-0.020", and the preferred metal type used is cartridge brass pre-plated with tin. Other thicknesses, metal types (copper alloys preferred), and platings are possible.

Figure 17:
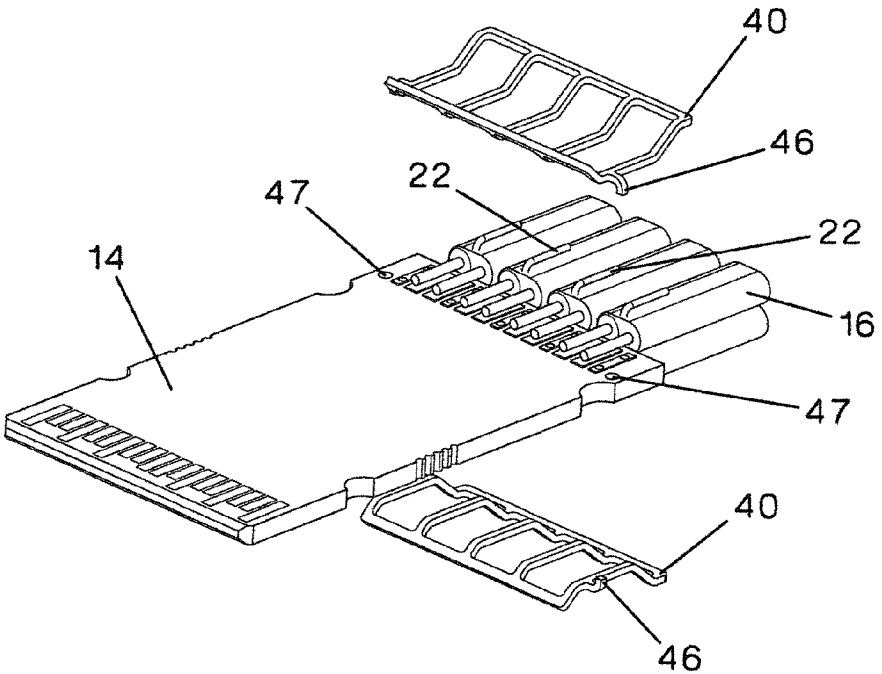
FIG. 17 is an exploded perspective detail view of the connector, PCB, and drain wire termination devices of FIG. 15.
Figure 18:
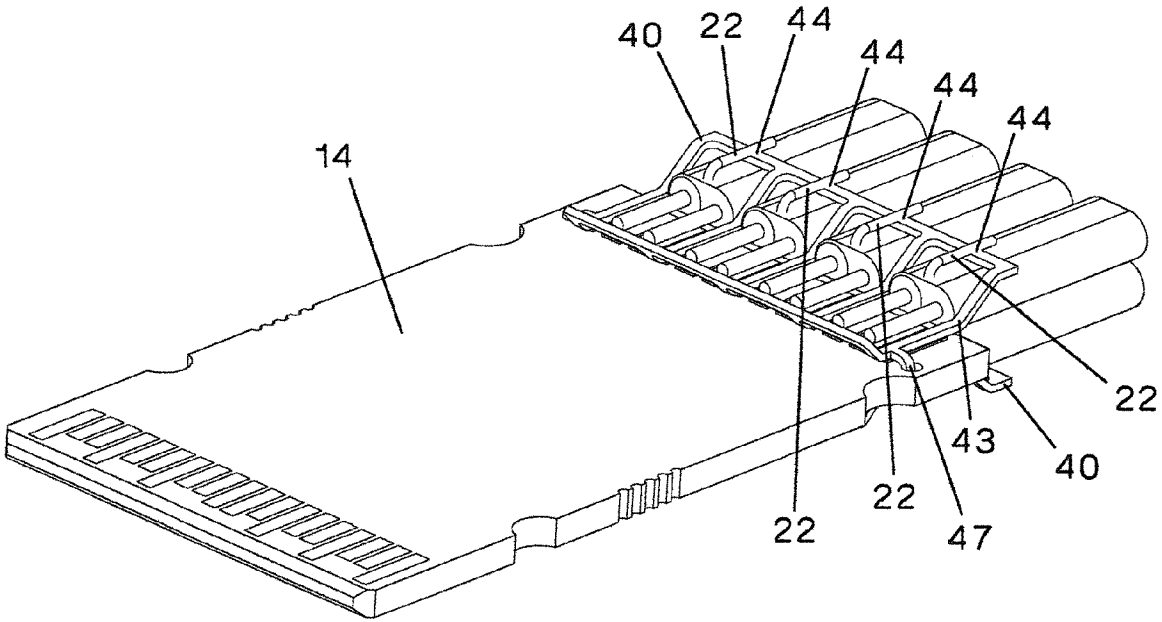
FIG. 18 is an assembled view of the detail of FIG. 17.

FIG. 17 shows an exploded view of PCB 14 and drain wire termination device 40, and FIG. 18 shows drain wire termination device 40 on the PCB 14. FIG. 18 particularly illustrates how drain wires 22 are pulled back and soldered on drain wire termination device 40 at drain wire termination locations 44. Preferably the termination locations 44 are on a centerline between the conductors 23 of each conductive pair 16. Fins 42 (shown in FIG. 19) allow for shielding between the neighboring conductive pairs 16, and when coupled with the drain wire 22 being soldered at location 44, allow for a symmetric termination of all signal conductors relative to ground for a given pair. Reinforcement bar 48 is lifted away from the circuit board so that it does not interact with the signal traces on PCB 14 that pass underneath it.

Figure 19:
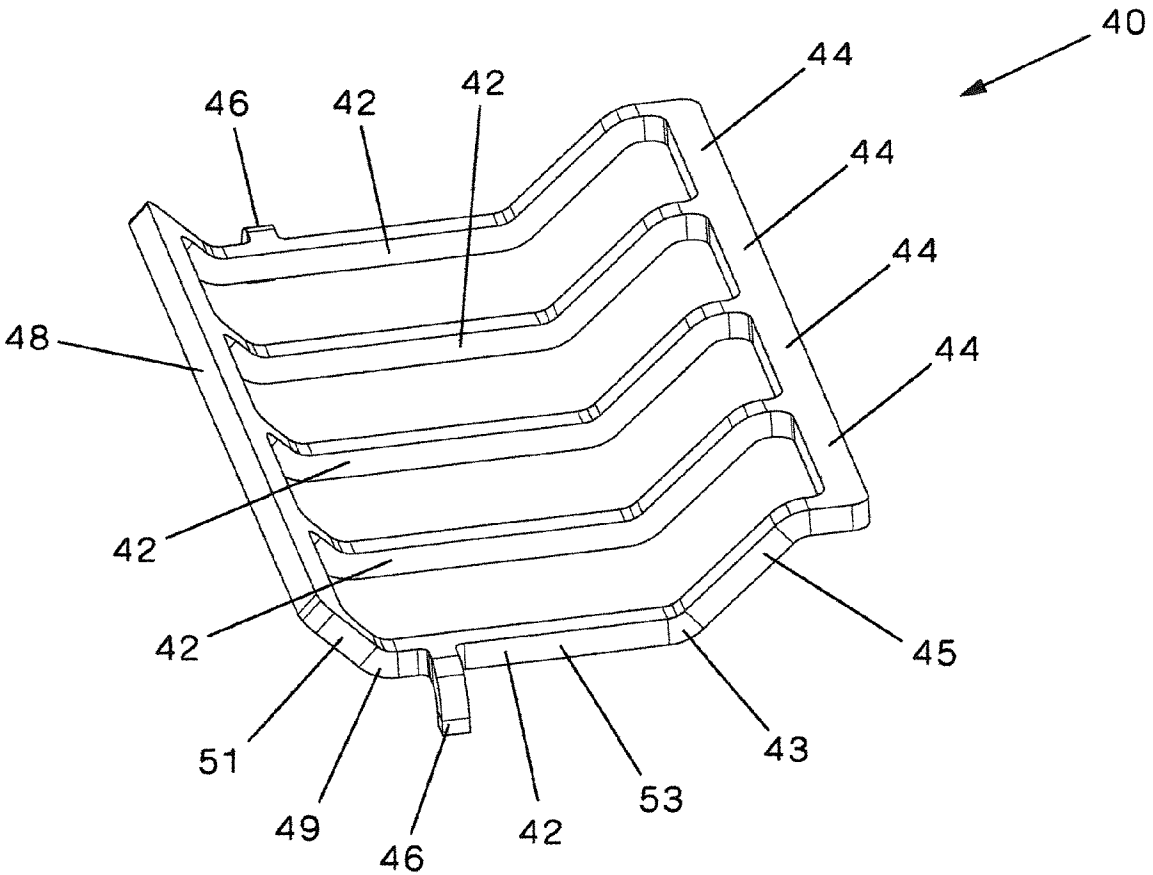
FIG. 19 is a perspective view of the drain wire termination device of FIGS. 15-18.

As shown in FIG. 19, a first bend 43 is a location where the drain wire termination device 40 is able to bend so that it fits in constrained locations. First bend 43 constitutes a flexible joint in drain wire termination device 40. The first bend 43 is disposed between a downwardly angled segment 45 of each fin 42 and a flat segment 53 of each fin that lies along or close to the PCB 14. Each fin 44 also includes a second bend 49 that is disposed between the flat segment 53 and an upwardly angled segment 51 of each fin.

In one embodiment, as shown in FIG. 19, each fin 44 is constructed with approximately the same shape and dimensions. However, according to other embodiments, some or all of the fins may be differently shaped. In some embodiments, the drain wire termination device may be provided without the reinforcement bar 48.

Figure 20:
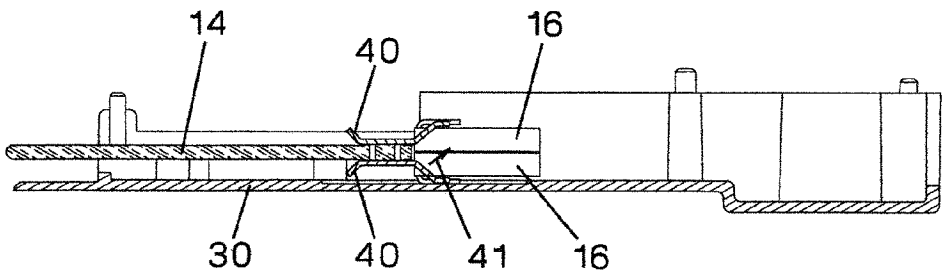
FIG. 20 is a cross-sectional view of the connector bottom shell PCB, and drain wire termination devices of FIG. 15.

FIG. 20 shows a side cut away view of two drain wire termination devices 40 attached to PCB 14. The drain wire termination device 40 is preferably a thin stamped part, and can therefore bend in direction 41 away from the bottom shell 30 and to easily fit within the QSFP cable assembly 13 when bottom and top shells 30 and 32 are mated. In one embodiment, some sort of insulating material (such as kapton tape, not shown) may be wrapped around the drain wire termination device 40 to prevent it from shorting to the bottom shell 30 and top shell 32.

As shown and described the present invention can be press-fit or soldered onto the circuit board for ease manufacturing. However, other methods of attachment such as ultrasonic welding, crimping; fastening with screws, rivets, bolts and/or nuts; encapsulating with potting compounds; and conductive adhesives or epoxies (or conductive tapes) are acceptable.

Pulling each drain wire directly above where the twin-ax foil has been removed and terminating it directly to the drain wire termination device of the present invention ensures that the drain wire termination retains a symmetrical relationship with both signal conductors during the termination process and that there is a very short path towards the ground on the circuit board. Termination during production is also simplified. Additionally, at least one embodiment of the present invention can be used with all wire gauges in the range of 24-30 AWG.

The fins on the drain wire termination device of the present invention that extend outward onto the circuit board may be directly attached to the PCB. These fins serve to block the direct NEXT coupling between the neighboring differential pairs by creating a ground between them. These fins also help create a symmetrical relationship between the signal conductors and ground within the region where they are attached to the PCB. This minimizes differential to common mode conversion. In other embodiments according to the present invention, the drain wire termination device can be made up of multiple pieces (for one or more of the devices used on either side of the PCB) or one large piece (rather than the two piece design shown), and still provide balance and reduce crosstalk. In other embodiments, rather than terminating the drain wire into the slot, the drain wire can be pulled into an insulation displacement contact (IDC) style termination. The features of the present invention can be incorporated when terminating twin-ax to a PCB on a different connector such as a 100 Gb/s connector, SFP+ connector, or any other connector which attaches to a twin-ax cable.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical connector, comprising:

a first shell;

an opposing second shell connected to said first shell;

a circuit board connected between said first shell and said second shell, said circuit board having a first side and an opposing second side, said circuit board including a plurality of differential pair conductive traces on each of said first side and said second side;

a first drain wire termination device connected to said first side approximately at said differential pair conductive traces, said first drain wire termination device including at least one first separator between at least one of said differential pair conductive traces on said first side and another of said differential pair conductive traces on said first side; and a second drain wire termination device connected to said second side approximately at said differential pair conductive traces, said second drain wire termination device including at least one second separator between at least one of said differential pair conductive traces on said second side and another of said differential pair conductive traces on said second side, wherein at least one of said first and second drain wire termination devices includes a reinforcement bar at a front end thereof.

2. The electrical connector of claim 1, wherein at least one of said first and second drain wire termination devices comprises at least two of respective said first or second separators, said at least one of said first and second drain wire termination devices further comprising symmetric drain wire termination between at least two of its respective separators.

3. The electrical connector of claim 1, wherein at least one of said first and second separators provides shielding between said at least one of said differential pair conductive traces and said another of said differential pair conductive traces on their respective sides.

4. The electrical connector of claim 1, wherein said circuit board includes at least one ground trace, at least one of said first and second separators connected to a said at least one ground trace.

5. The electrical connector of claim 1, wherein at least one of said first and second drain wire termination devices includes a drain wire attachment bar at a rear end thereof.

6. The electrical connector of claim 5, wherein said at least one of said first and second drain wire termination devices includes tabs for that mate with said circuit board.

7. A cable assembly, comprising:

a twin-ax cable having a plurality of differential conductor pairs, each of said differential conductor pairs including a corresponding drain wire;

an electrical connector connected to said twin-ax cable, said electrical connector including:

a first shell;

an opposing second shell connected to said first shell;

a circuit board connected between said first shell and said second shell, said circuit board having a first side and an opposing second side, said circuit board including a plurality of differential pair conductive traces on each of said first side and said second side, said plurality of differential pair conductive traces connected to corresponding pairs of said plurality of differential conductor pairs;

a first drain wire termination device connected to said first side approximately at said differential pair conductive traces, said first drain wire termination device including at least one first separator between at least one of said differential pair conductive traces on said first side and another of said differential pair conductive traces on said first side, said first drain wire termination device connected to at least one of said drain wires on said first side; and a second drain wire termination device connected to said second side approximately at said differential pair conductive traces, said second drain wire termination device including at least one second separator between at least one of said differential pair conductive traces on said second side and another of said differential pair conductive traces on said second side, said second drain wire termination device connected to at least one of said drain wires on said second side wherein at least one of said first and second drain wire termination devices includes a reinforcement bar at a front end thereof.

8. The cable assembly of claim 7, wherein at least one of said first and second drain wire termination devices comprises at least two of respective said first or second separators, said at least one of said first and second drain wire termination devices further comprising a symmetric drain wire termination between at least two of its respective separators.

9. The cable assembly of claim 7, wherein at least one of said first and second separators provides shielding between said at least one of said differential pair conductive traces and said another of said differential pair conductive traces on their respective sides.

10. The cable assembly of claim 7, wherein said circuit board includes at least one ground trace, at least one of said first and second separators connected to a said at least one ground trace.

11. The cable assembly of claim 7, wherein at least one of said first and second drain wire termination devices includes a drain wire attachment bar at a rear end thereof.

12. The cable assembly of claim 11, wherein said at least one of said first and second drain wire termination devices includes tabs that mate with said circuit board.

13. A method of terminating an electrical connector to a twin-ax cable, the method comprising the steps of:

trimming insulation from differential conductive pairs and respective drain wires of the twin-ax cable;

connecting said differential conductive pairs to a side of a printed circuit board of the electrical connector;

separating at least one of said differential conductive pairs from another of said differential conductive pairs with a drain wire termination device, wherein said drain wire termination device includes a reinforcement bar at a front end thereof;

placing said drain wires on said drain wire termination device, each of said drain wires being arranged symmetrically with respect to a corresponding one of said differential conductive pairs;

terminating said drain wires to said drain wire termination device; and minimizing crosstalk between said differential conductive pairs.

14. The method of claim 13, further including the steps of connecting other said differential conductive pairs to another side of said printed circuit board, and separating other said differential conductive pairs using a second drain wire termination device on said another side of said printed circuit board.

15. The method of claim 14, further including the steps of placing other said drain wires on said second drain wire termination device for said another side of said printed circuit board, each of said other drain wires being arranged symmetrically with respect to a corresponding one of said differential conductive pairs, and terminating said other drain wires to said second drain wire termination device.

* * * * *